United States Patent [19]

Sian

[11] Patent Number: 4,472,017

[45] Date of Patent: Sep. 18, 1984

[54] TAB RECEPTACLE TERMINAL

[75] Inventor: Sucha S. Sian, Southfield, Mich.

[73] Assignee: Essex Group, Inc., Fort Wayne, Ind.

[21] Appl. No.: 481,513

[22] Filed: Apr. 1, 1983

[51] Int. Cl.[3] ..... H01R 4/24; H01R 13/11

[52] U.S. Cl. ..... 339/217 S; 339/258 S

[58] Field of Search ..... 339/217 S, 256 R, 256 SP, 339/258 R, 258 F, 258 P, 258 S

[56] References Cited

U.S. PATENT DOCUMENTS

| | | | |
|---|---|---|---|
| 3,562,698 | 2/1971 | Merry | 339/217 |
| 3,609,640 | 9/1971 | Longnecker et al. | 339/91 |
| 3,713,080 | 1/1973 | Kennedy | 339/258 |
| 3,718,895 | 2/1973 | Reynolds et al. | 339/258 |
| 3,796,987 | 3/1974 | Kinkaid et al. | 339/217 S |
| 3,808,589 | 4/1974 | Bonhomme | 339/258 R |
| 3,992,076 | 11/1976 | Gluntz | 339/258 |
| 4,068,915 | 1/1978 | Evans | 339/176 |
| 4,076,369 | 2/1978 | Ostapovitch | 339/258 |
| 4,306,761 | 12/1981 | Ress, Jr. | 339/252 |

*Primary Examiner*—Joseph H. McGlynn
*Assistant Examiner*—Steven C. Bishop
*Attorney, Agent, or Firm*—Robert D. Sommer

[57] ABSTRACT

A tab receptacle terminal which adapted to be inserted in an insulating housing comprises a box-like main body portion and two cantilever spring contact members extending from the tab-entry end of the body portion and bent back inside the body portion. A spring retention tang struck from each of two opposed side members of the body portion has an inwardly directed projection engageable by a respective one of the contact members upon flexing of the responsive to insertion of a blade tab between the contact members to bias the tang into retaining relation with an abutment shoulder formed in the housing.

2 Claims, 7 Drawing Figures

FIG. 1
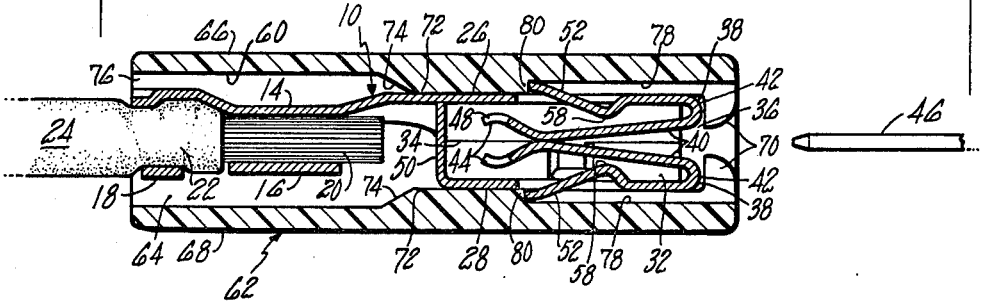
FIG. 2
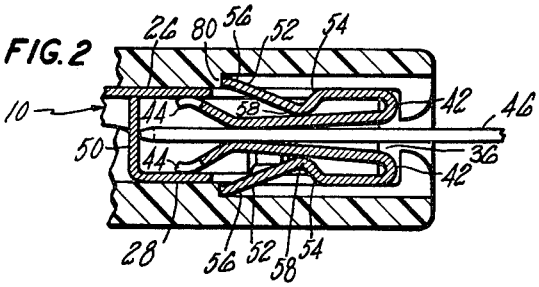
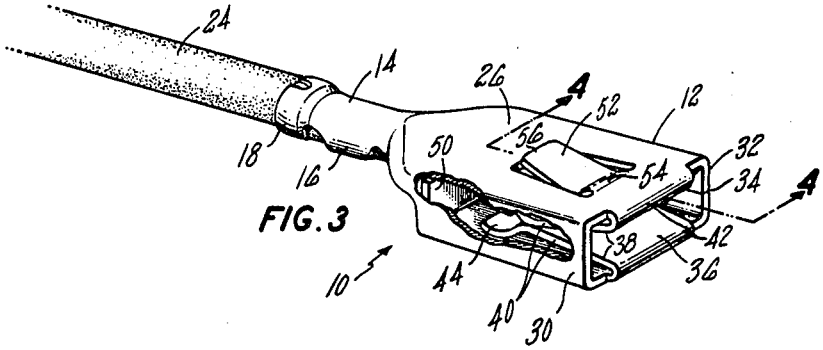
FIG. 3
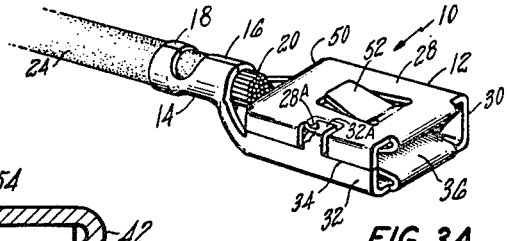
FIG. 3A
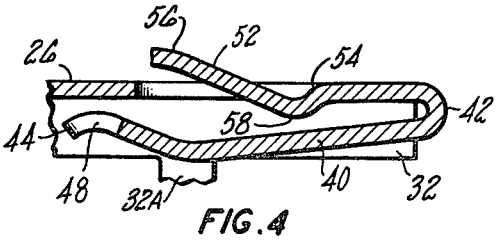
FIG. 4

FIG. 5
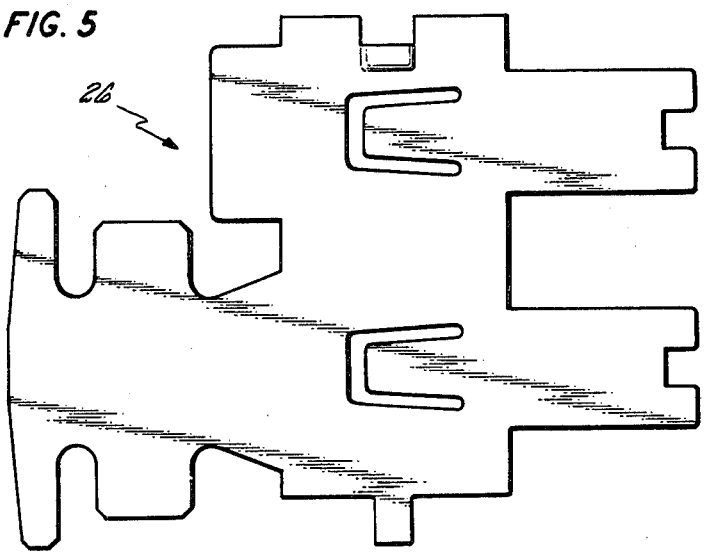
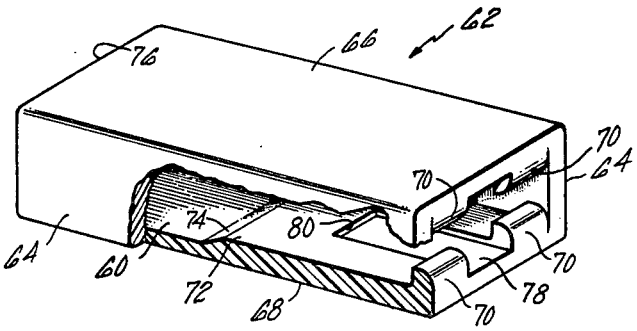
FIG. 6

TAB RECEPTACLE TERMINAL

BACKGROUND OF THE INVENTION

This invention relates generally to electrical connectors and more particularly to electrical tab receptacle terminals of the type having a pair of cantilever spring contact members disposed within a box-like body that is adapted for mounting in an insulating housing.

A known type of tab receptacle terminals formed from sheet metal comprises a box-like main body portion with extensions of two opposed sides bent back within the body portion to form cantilever spring contacts between which a tab or pin may be inserted and gripped. Examples of this type of terminals are disclosed in U.S. Pat. Nos. 3,609,640, 3,713,080, 3,718,895, 3,992,076 and 4,076,369. The terminal shown in Pat. No. 3,992,076 has an outwardly projecting resilient retention tang struck from one side of its body portion for securing the terminal in a cavity of an insulating housing. Other examples of terminals provided with a resilient retention tang are disclosed in U.S. Pat. Nos. 3,562,698, 4,068,915 and 4,306,761.

Tab receptacle terminals of the type referred to above are commonly produced in continuous strip form with a plurality of terminals connected at their ends in side-by-side relation to either one or two carrier strips. The strips of terminals are commonly wound on a reel for subsequent application to electric wires by a terminal press which sequentially separates the terminals from the carrier strips and crimps a wire connecting portion of each terminal to a wire. During handling of the strips of terminals, the outwardly projecting retention tang of a terminal may be accidentally depressed into the main body portion of the terminal and not return to its original position. After such a damaged terminal is inserted into an insulating housing, its retention tang is ineffective to adequately secure the terminal to the housing. Consequently, the terminal may be pushed out of the housing by the engagement forces produced when an attempt is made to mate the terminal with a complementary tab.

SUMMARY OF THE INVENTION

The present invention provides an improved tab receptacle terminal of the type comprising a box-like main body portion having an extension at its forward tab-entry end bent back inside the body portion from each of two opposed side members to provide two cantilever spring contact members between which a blade tab may be inserted and gripped. A spring retention tang struck from each of the opposed side members extends generally lengthwise of the body portion with a forward end portion connected to its respective side member and a free inclined rear portion extending rearwardly and outwardly with respect to its associated side member. The forward end portion of each tang is inwardly bowed to define a projection adjacent the contact member of the associated side member. These projections are engageable by the respective contact members upon flexing of the latter responsive to insertion of a blade tab therebetween to bias the respective rear portions of the tangs outwardly.

The tab receptacle terminal of the present invention is adapted to be inserted in an insulating housing having a terminal receiving passageway therein open to the rear of the housing which has a forward stop and a pair of opposed walls each providing an intermediately located internal abutment shoulder for engagement by a respective one of the tangs of the terminal. After the terminal is inserted in the passageway of the housing, the insertion of a blade tab between the contact members results in the flexing of the contact members against the projections of the tangs to ensure that the tangs are each in a retaining relation with respect to an abutment shoulder.

For a better understanding of the invention, reference may be had to the following detailed description taken in connection with the accompanying drawings, in which:

BRIEF DESCRIPTION OF THE DRAWINGS

FIG. 1 is a sectional view showing the terminal of the present invention disposed within an insulating housing for reception of a complemental tab shown fragmentarily;

FIG. 2 is a fragmentary sectional view of the terminal and insulating housing showing the tab inserted into the terminal;

FIG. 3 is a top perspective view partly broken away and partly in section of the terminal;

FIG. 3A is a bottom perspective view to a reduced scale of the terminal;

FIG. 4 is a sectional view taken along the line 4—4 of FIG. 3;

FIG. 5 is a plan view of the sheet metal blank from which the terminal of FIG. 1 is formed; and FIG. 6 is a perspective view partly broken away and partly in section of the insulating housing.

DESCRIPTION OF THE PREFERRED EMBODIMENT

Referring now to the drawings, a tab receptacle terminal 10 according to the present invention includes a box-like main body portion 12 of elongate form and a wire connecting portion 14 extending from the rear end of the main body portion 12. As is well known, the wire connecting portion 14 comprises two initially open U-shaped ferrules 16 and 18 for crimping respectively to the conductive core 20 and the outer insulation 22 of a wire 24. The terminal 10 may be formed from a suitable electrically conductive sheet metal such as cartridge brass by shaping a blank 26 of the form shown in FIG. 5. It will be apparent that the sheet metal should be sufficiently hard and resilient to impart a spring quality to elements of the main body portion 12 yet be sufficiently malleable to permit crimping of the wire connecting portion 12 about the end of a wire 24.

The main body portion 12 includes four generally flat side members 26, 28, 30 and 32 arranged with the side members 26 and 28 in opposed relation and the side members 30 and 32 in opposed relation. The side members are joined at respective edges of the body portion 12 with a seam 34 extending generally along the length of the side member 32. The side member 28 has an inwardly offset portion or outer recess 28A in which is engaged a locking tongue 32A extending from one section of the side member 32 through a notch in the other section to prevent separating movement of the body portion 12 at the seam 34. At the forward tab-entry end 36 of the body portion 12, each of the side members 26 and 28 has an extension 38 bent back inside the body portion 12 to form a cantilever spring contact member 40 extending from a bight 42 back into the interior of the body portion 12.

The contact members 40 converge to engage each other adjacent the free or rearward ends 44 thereof and thus define an open mouth guide into which a blade tab 46 of conventional construction may be inserted. The contact members 40 are spread apart upon insertion of a blade tab 46 therebetween and resiliently exert contact pressure on the inserted tab 46. The free ends 44 are outwardly bent toward the respective side members 26 and 28 for engagement therewith to resiliently limit the spreading apart of the contact members 40. At its extremity, each free end 44 may be longitudinally divided by a slot 48. A stop flap 50 is formed as an extension of the side member 28 at the rear end thereof and is inwardly bent to extend across the rear end of the body portion 12 for limiting insertion of the tab 46 into the body portion 12. The wire connecting portion 14 constitutes an extension of the side member 26.

A spring retention tang 52 is struck from at least one and preferably each of the side members 26 and 28. Each tang 52 has a forward end portion 54 integrally connected to its respective side member 26 or 28 and a free inclined rear portion 56 extending rearwardly and outwardly with respect to the body portion 12. The forward end portion 54 of each tang 52 is inwardly bowed to define a projection 58 disposed close to the adjacent contact member 40 of the associated side member 26 or 28. When the contact members 40 are spread apart upon a receiving a blade tab 46 therebetween, the contact members 40 engage the respective projections 58 to bias the respective rear portions 56 of the tangs 52 outwardly with respect to their associated side members.

As shown in FIG. 1, the terminal 10 is adapted to be inserted longitudinally into the terminal receiving passageway 60 of a conventional insulating body or housing 62. The housing 62 is in the form of a tube having a pair of spaced parallel side walls 64 joined by top and bottom walls 66 and 68. At the front or mating end of the housing 62, a pair of inwardly directed stop members 70 depend from each of the walls 66 and 68 adjacent the side walls 64. These stop members 70 serve as a forward stop to limit forward movement of a terminal 10 inserted into the passageway 60 and also serve as a guide for insertion of a tab 46 into the tab-entry end 36 of the body portion 12. The top and bottom walls 66 and 68 of the housing 62 each have an identical forwardly located boss portion 72 projecting into the passageway 60. Each boss portion 72 has a rearward ramp portion 74 spaced forwardly of the rear opening 76 and a forward longitudinal slot 78 providing a forwardly facing abutment shoulder 80.

Since both the passageway 60 of the housing 62 and the body portion 12 of the terminal 10 are symmetrical with respect to respective horizontal bisecting planes, the terminal 10 may be inserted into the passageway 60 through the rear opening 76 with the orientation shown in FIG. 1 or with a reversed orientation. As the body portion 12 of the terminal 10 passes between the boss portions 72 of the housing 62, the ramp portions 74 engage the rear portions 56 of the tangs 52 to depress the tangs 52 into the body portion 12. When the terminal 10 is further inserted to the fully assembled position shown in FIG. 1, the rear portions 56 of the tangs 52 snap into the slots 78 and are retained therein by the shoulders 80. Thus engagement of the shoulders 80 by the tangs 52 prevents withdrawal of the terminal 10 through the rear opening 76 while engagement of the body portion 12 with the stop members 70 prevents the terminal 10 from leaving the housing 62 at the other end. It will be apparent, however, that removal of the terminal 10 from the housing 62 could be effected, if desired, by inserting two narrow blades of a suitable tool (not shown) into the slots 78 from the front of the housing 62 to depress the tangs 52 into the body portion 12.

After the terminal 10 has been assembled with the housing 62, a blade tab 46 may be inserted through the forward end of the housing passageway 60 between the pairs of stop members 70 into the tab-entry end 36 of the terminal 10. Insertion of the tab 46 into the body portion 12 spreads the contact members 40 apart, bringing their free ends 44 into engagement with the respective side members 26 and 28. This flexing of the contact members 40 establishes a spring contact pressure of a desired value between the tab 46 and the contact members 40. At the same time, the projections 58 of the tangs 52 are engaged by the respective contact members 40 upon the flexing of the latter to bias the respective rear portions 56 of the tangs 52 outwardly thereby ensuring that the tangs 52 remain in retaining relation with the housing 62. In the event that either of the tangs 52 had been accidentally depressed within the body portion 12 during handling prior to assembly of the terminal 10 with the housing 62 and had not returned to its extending condition, it will automatically be restored to its extended latching condition upon insertion of a tab 46 into the body portion 12.

While there has been described above the principles of the invention in connection with a specific tab receptacle terminal construction, it is to be understood that this description is made only by way of example and not as a limitation to the scope of the invention.

What is claimed is:

1. An electrical tab receptacle terminal adapted to be inserted in an insulating housing having a terminal receiving passageway therein open to the rear of the housing which has a forward stop at the front of the housing and a wall providing an intermediately located internal abutment shoulder, said terminal being of unitary sheet metal construction and comprising:

a box-like main body portion of elongate form having an entry end for reception of a blade terminal; said body portion having four side members arranged with first and second side members in opposed relation and with third and fourth side members in opposed relation;

each of the first and second side members including an extension bent back inside the body portion from said entry end to form a cantilever spring contact member extending from a bight back into the interior of the body portion; said contact members being convergent to engage each other adjacent the free ends thereof to define a guide for insertion of a blade tab therebetween; and a spring retention tang struck from said first side member and extending generally lengthwise thereof; said tang having a forward end portion connected to the first side member and a free inclined rear portion extending rearwardly and outwardly with respect to the first side member for engagement with said abutment shoulder when the body portion is disposed in said passageway; the forward end portion of said tang being inwardly bowed to define a projection adjacent the contact member of the first side member; said projection being engageable by the contact member of the first side member upon flexing of the latter contact member toward the first side member responsive to insertion of a blade tab between the contact members to thereby bias the rear portion of the tang outwardly with respect to the first side member.

2. An electrical terminal for mating with a blade tab and adapted to be inserted in an insulating housing having a terminal receiving passageway therein open to the rear of the housing which has a forward stop and two opposed walls each providing an intermediately located internal abutment shoulder, said terminal being of unitary sheet metal construction and comprising:

a box-like main body portion of elongate form having an entry end for reception of a blade terminal; said body portion having four side members arranged with first and second side members in opposed relation and with third and fourth side members in opposed relation;

each of the first and second side members including an extension bent back inside the body portion from said entry end to form a cantilever spring contact member extending from a bight back into the interior of the body portion; said contact members being convergent to engage each other adjacent the free ends thereof to define a guide for insertion of a blade tab therebetween; and a spring retention tang struck from each of said first and second side members and extending generally lengthwise of the body portion; each tang having a forward end portion connected to its respective side member for engagement with a corresponding one of said abutment shoulders when the body portion is disposed in said passageway; the forward end portion of each tang being inwardly bowed to define a projection adjacent the contact member of the associated side member; said projections being engageable by the respective contact members upon flexing of the latter toward their respective side members responsive to insertion of a blade tab therebetween to thereby bias the respective rear portions of the tangs outwardly with respect to their associated side members.

* * * * *